United States Patent [19]

Johnson

[11] Patent Number: 5,066,136

[45] Date of Patent: Nov. 19, 1991

[54] VIBRATORY MIXERS

[75] Inventor: Alan S. Johnson, Maidenhead, Great Britain

[73] Assignee: Red Devil, Inc., Union, N.J.

[21] Appl. No.: 608,023

[22] Filed: Oct. 29, 1990

Related U.S. Application Data

[63] Continuation of Ser. No. 162,548, Mar. 1, 1988, abandoned.

[30] Foreign Application Priority Data

Jul. 1, 1986 [GB] United Kingdom ..... 8616034
Jun. 25, 1987 [GB] United Kingdom.PCT/GB87/00446

[51] Int. Cl.[5] ..... B01F 11/00; B01F 3/12
[52] U.S. Cl. ..... 366/209; 366/605
[58] Field of Search ..... 366/605, 208, 209, 210, 366/211, 216, 217, 108, 110, 111

[56] References Cited

U.S. PATENT DOCUMENTS

| | | | |
|---|---|---|---|
| 4,134,689 | 1/1979 | Ahrenskou-Sorensen | 366/128 |
| 4,225,248 | 9/1980 | Para | 366/605 |
| 4,415,270 | 11/1983 | Heinis et al. | 366/216 |
| 4,445,782 | 5/1984 | Sparrow, Jr. | 366/217 |
| 4,588,302 | 5/1986 | Pizzi et al. | 366/605 |
| 4,615,148 | 10/1986 | Harper, Jr. | 366/217 |
| 4,619,532 | 10/1986 | Schmidt, III | 366/128 |
| 4,789,245 | 12/1988 | Morbeck | 366/605 X |

*Primary Examiner*—Harvey C. Hornsby
*Assistant Examiner*—Scott J. Haugland
*Attorney, Agent, or Firm*—Lane, Aitken & McCann

[57] ABSTRACT

A vibratory mixer for mixing ingredients by shaking comprising a load platform (51) for receiving a container (88) which holds the ingredients to be mixed, clamping means (47) cooperable with the load platform to clamp a container (88) therebetween, means (14, 26 to 48) for effecting relative movement between the load platform (51) and the clamping means (47) so as to clamp and unclamp a container, said means comprising at least one lead screw (38, 42) and a first motor (14) operable to drive the or each screw, the or at least one of the lead screws (42) being axially movable, the apparatus further comprising a second motor (13) operable to shake the load platform (51), and control means operable to control the sequence of operation of the apparatus and comprising switch means (65) connected in circuit with the first motor (14) and actuatable on axial movement of said the or at least one lead screw (42) which takes place due to the reaction of a container (88) being clamped between the load platform (51) and the clamping means (47) whereby the first motor (14) is de-energized before the second motor (13) is energized.

33 Claims, 7 Drawing Sheets

VIBRATORY MIXERS

Figure 1:
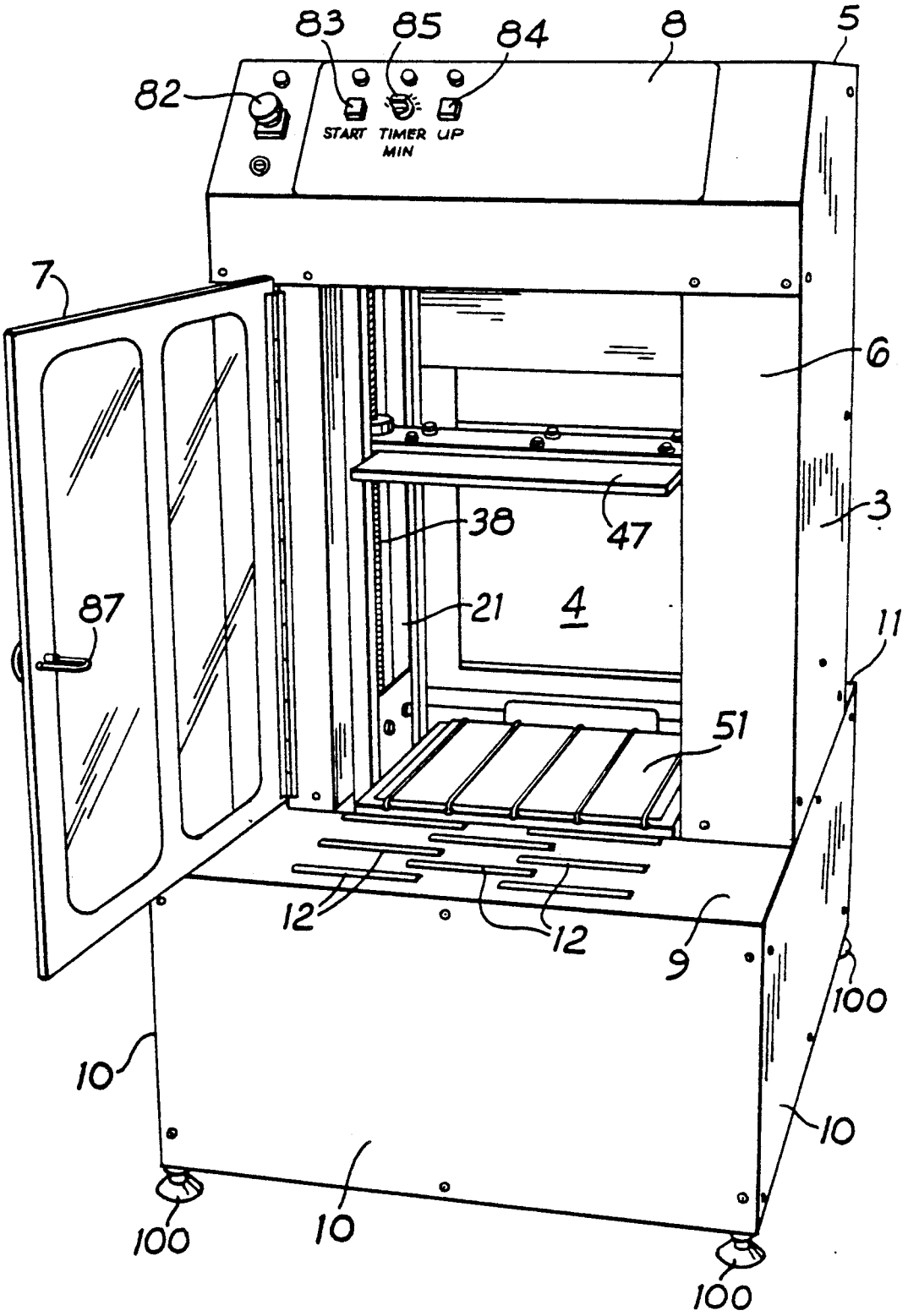

This application is a continuation of application Ser. No. 162,548, filed Mar. 1, 1988, now abandoned which is a continuation of PCT application No. PCT/GB87/00446 filed on 25 June 1987, withdrawn as to the United States.

This invention relates to vibratory mixers for mixing ingredients and has particular, but not exclusive, reference to the mixing of paints either in production or at the point of sale.

It is becoming increasingly popular to select a precise color shade for a gloss or emulsion paint and to have that color mixed at the point of sale. This involves taking a container of a base color and adding to it one or more tinters according to the formula pertaining to the selected shade, and then shaking or vibrating the container using a vibratory mixer to effect thorough mixing.

Vibratory mixers are known and suffer from certain disadvantages. One particular known vibratory mixer is disclosed in GB-A-1,586,953 and comprises a load table for receiving a container holding the ingredients to be mixed, a clamping plate movable relative to the load platform to clamp and unclamp the container therebetween by means of axially fixed lead screws driven by a motor. When a container is to be clamped between the load table and the clamping plate, it is placed on the load table and the motor then actuated which rotatably drives the lead screws in unison and thus moves the clamping plate towards the load table. When the clamping plate engages the container on the load platform, the motor is stalled which increases the current therethrough. The stall current is sensed and when it reaches a predetermined value, the motor is de-energized or the power reduced sufficiently to obtain a hold situation.

There are a number of problems with this known arrangement, one being that both metallic and synthetic plastics containers are used in the paint industry and the clamping force cannot be adjusted with the result that containers can be damaged on clamping with an attendant problem of the contents leaking when shaken. Another problem is that a given machine has to be able to accept a relatively large range of container sizes, for example from ¼ liter to 25 liters and there is no provision for identifying the container size or material from which it is constructed Accordingly, it has been found that not only does this known machine suffer from overclamping but also from underclamping, the latter meaning that a container can be thrown off the load platform when shaken. A third problem is that fluctuations in the power supply for the clamping motor, which are not uncommon, appear to affect the clamping force which again, may be too high or too low.

It is an object of the present invention to provide a vibratory mixer which obviates the aforementioned problems.

According to one aspect of the present invention there is provided a vibratory mixer for mixing ingredients by shaking comprising a load platform for receiving a container which holds the ingredients to be mixed, clamping means cooperable with the load platform to clamp a container therebetween, means for effecting relative movement between the load platform and the clamping means so as to clamp and unclamp a container, said means comprising at least one lead screw and a first motor operable to drive the or each screw, the or at least one of the lead screws being axially movable, the apparatus further comprising a second motor operable to shake the load platform, and control means operable to control the sequence of operation of the apparatus and comprising switch means connected in circuit with the first motor and actuatable on axial movement of said the or at least one lead screw which takes place due to the reaction of a container being clamped between the load platform and the clamping means, whereby the first motor is de-energized before the second motor is energized.

Preferably, two interconnected lead screws are provided, one of which is axially movable and the other axially fixed, with the latter being driven. Also the clamping means, which may be in the form of a plate, is preferably moved relative to the load platform and which is thus carried by the lead screw(s). In order to accommodate the axial movement of at least one lead screw as a result of the reaction of a container when contacted by the clamping means, the latter is set out of parallel with the load platform by an amount substantially equal to the axial movement of the movable lead screw, whereby in the final clamped position of a container the clamping means and the load table are substantially mutually parallel. The axial movement of the movable lead screw is preferably of the order of 2 mm.

The switch means is preferably located at the end of the movable lead screw and spaced therefrom by a predetermined distance, such as 1 mm, so as to be actuated by the lead screw when it is moved axially by container reaction. Actuation of the switch means de-energizes the first motor and unless instantaneous arrest thereof is provided for, the motor will overrun probably by about up to 3 mm but this is acceptable, indeed desired, in order to finalize the container clamping. The load platform and/or clamping means may be lined with a resilient material into which the container becomes embedded to some extent to help secure it in the clamped position.

The control means may comprise timing means which operates to energize the second motor once the first motor has been de-energized and then vice versa when the clamped container has been shaken or vibrated for a predetermined period of time, whereby the container is automatically unclamped for removal.

The first motor may drive the or each lead screw via a belt which extends between a pulley on the output shaft of the motor and a pulley on a countershaft which is fitted with a further pulley around which extends a further belt engaging a still further pulley on a further shaft substantially parallel to the countershaft and carrying a bevel gear which mates with a further bevel gear carried by the driven lead screw. It is important for the countershaft and the further shaft to be maintained substantially parallel and to this end, the two shafts may be interconnected by an adjustable linkage. When the first motor is de-energized with a container in the clamped position, it is important that the drive train to the driven lead screw is locked so as to prevent inadvertent movement which might result in overclamping or underclamping. Accordingly, one of the pulleys in the drive train may be provided with a series of extensions which are engageable by a pawl member actuated by a solenoid on de-energization of the first motor so as to prevent rotation of the pulley and hence movement of the drive train.

The second motor may drive a vibratory mechanism via a belt and pulley arrangement, the vibratory mechanism comprising a flywheel which is attached to an inner frame carrying the load platform and suspended from a main, and stationary frame for relative movement with respect thereto. The connection of the flywheel to the inner frame may be via an eccentric pin but this closes the gap between the end of the output shaft of the second motor and the inner frame which means that it is a cumbersome and time-consuming exercise to change a drive belt which is necessary from time to time in view of the load thereon. According to a preferred feature of the present invention, the eccentric pin is made removable by providing a threaded connection with the flywheel and providing a head on the pin for screwing and unscrewing the pin. Thus, belt changing for the second motor is a simple matter and all that is required is the removal of the eccentric pin.

In order to effect belt tensioning, the first and second motors are preferably mounted on adjustable plates or cradles which may be slidingly or hingedly mounted on the main frame.

The machine may comprise a feed platform which may be provided with means for assisting movement of a container to and from the load platform. The means may comprise driven or freely rotatable rollers. If required, the machine may also be provided with an unloading platform, whereby a container may be moved from the feed platform to the load platform, clamped, shaken, unclamped and then moved to the unloading platform. Such an arrangement is particularly relevant to a continuous production line.

According to another aspect of the present invention there is provided a vibratory mixer for mixing ingredients by shaking comprising a load platform for receiving a container which holds the ingredients to be mixed, clamping means cooperable with the load platform to clamp a container therebetween, means for effecting relative movement between the load platform and the clamping means so as to clamp and unclamp a container, first motor means forming part of said means to effect said relative movement, and second motor means operable to effect shaking of the load platform to mix the ingredients in a clamped container, the first and second motor means being located generally opposite one another in a given direction so as substantially to balance the machine in that direction.

According to another aspect of the invention there is provided a vibratory mixer for mixing ingredients by shaking comprising a load platform for receiving a container which holds the ingredients to be mixed, clamping means cooperable with the load platform to clamp a container therebetween, means for effecting relative movement between the load platform and the clamping means so as to clamp and unclamp a container, a feed platform mounted generally coplanar with the load platform when the latter is in a container-receiving position and operable to receive a container to be loaded on to the load platform, the feed platform being provided with means for assisting the movement of a container from the feed platform to the load platform.

The means may comprise driven or freely rotatable rollers and an unloading platform similar to the feed platform may be provided on the opposite side of the load platform.

Figure 2:
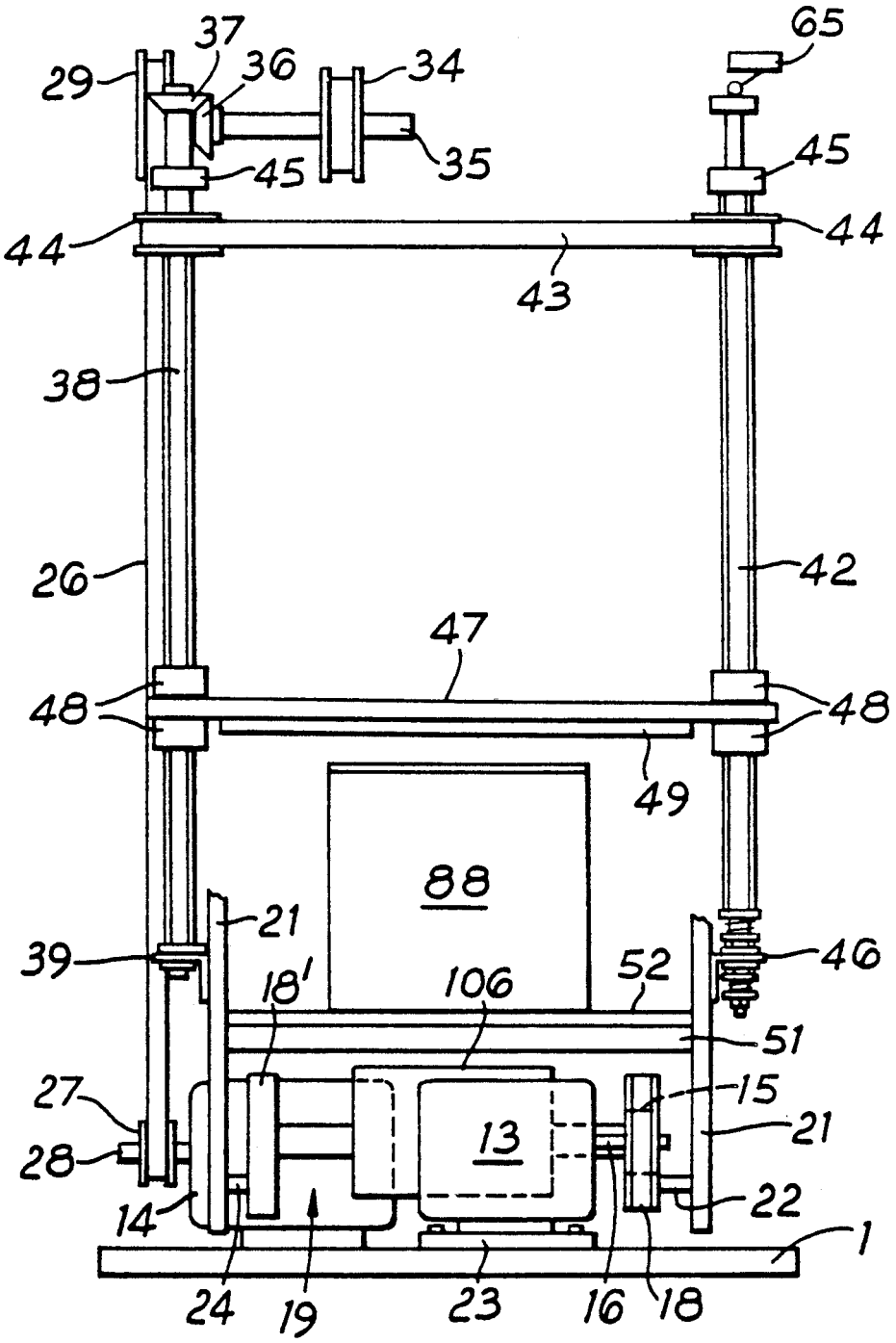
Figure 4:
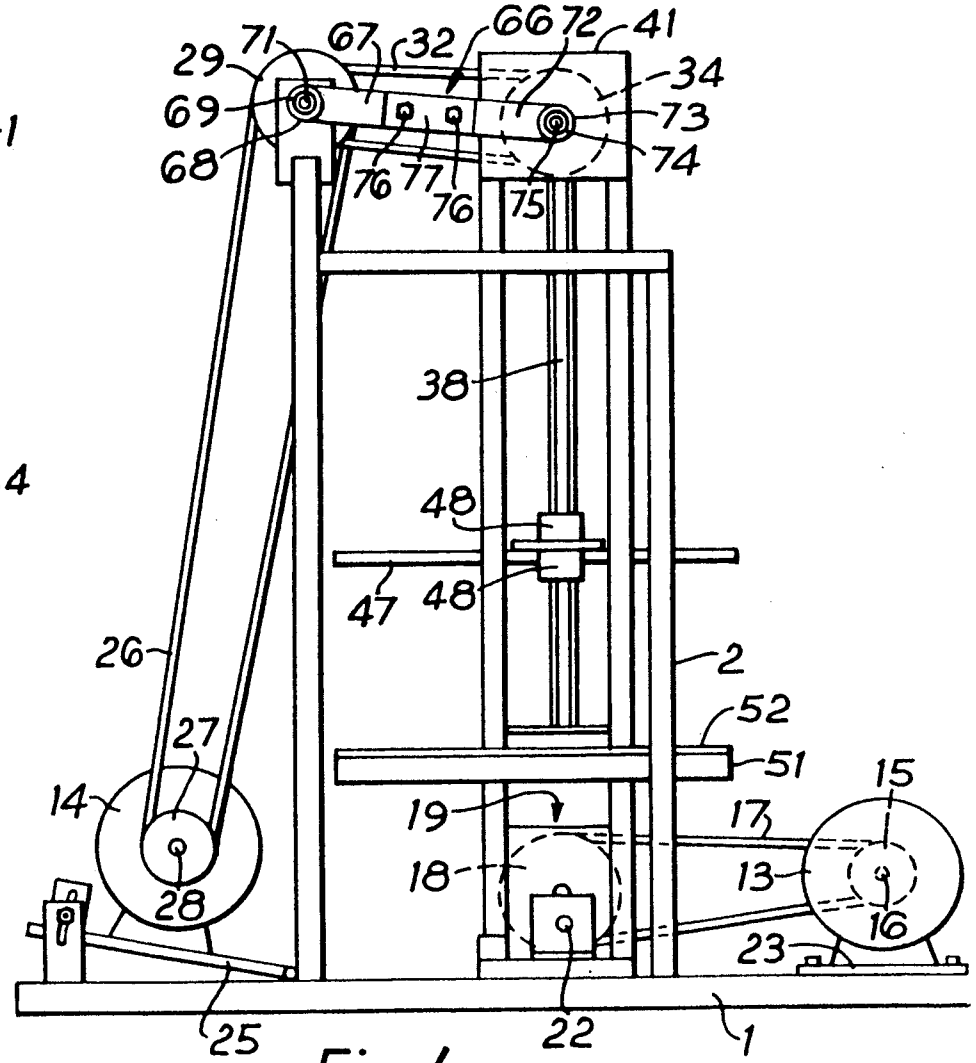
Figure 3:
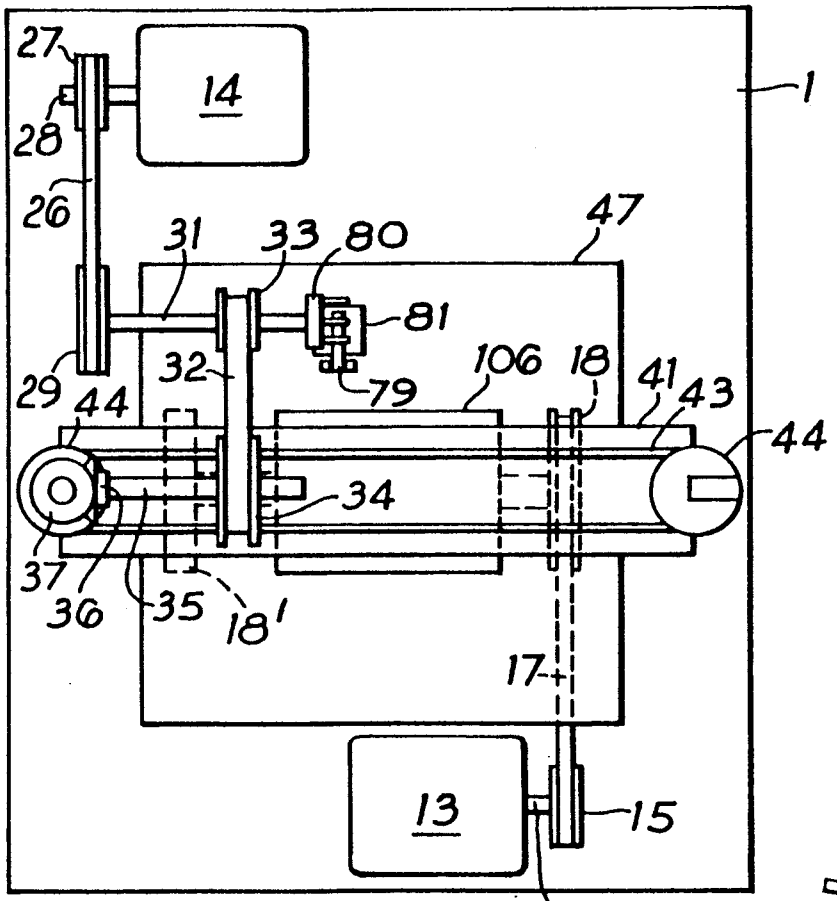
Figure 5:
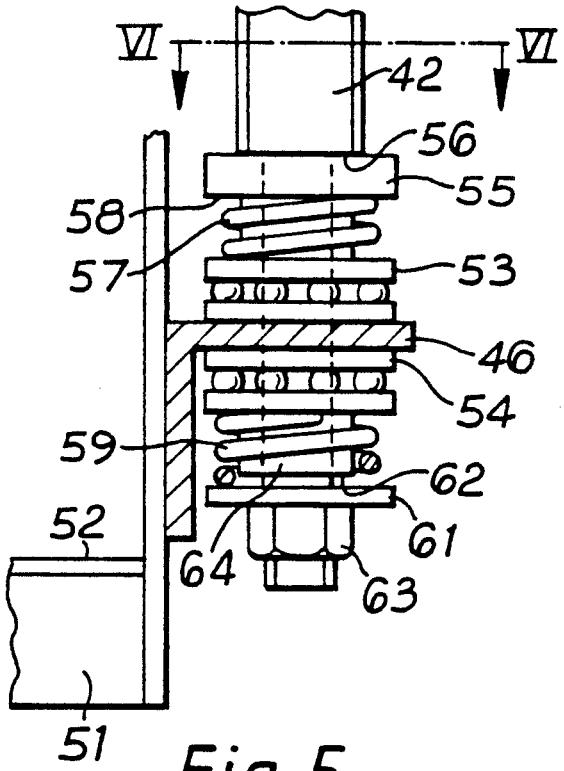
Figure 6:
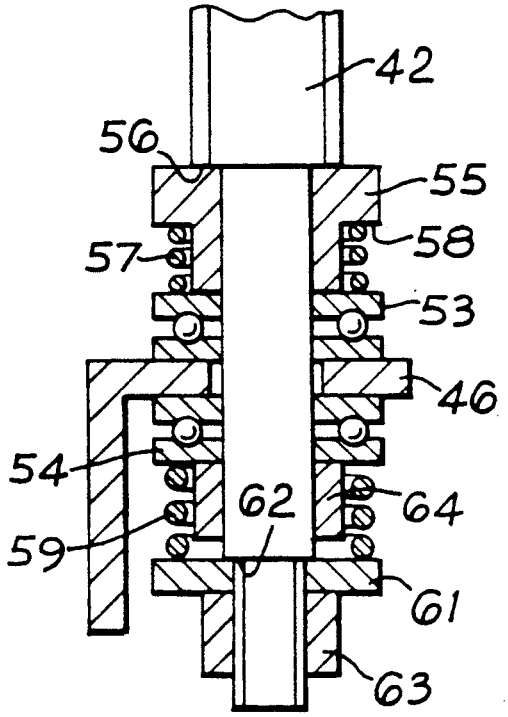
Figure 7:
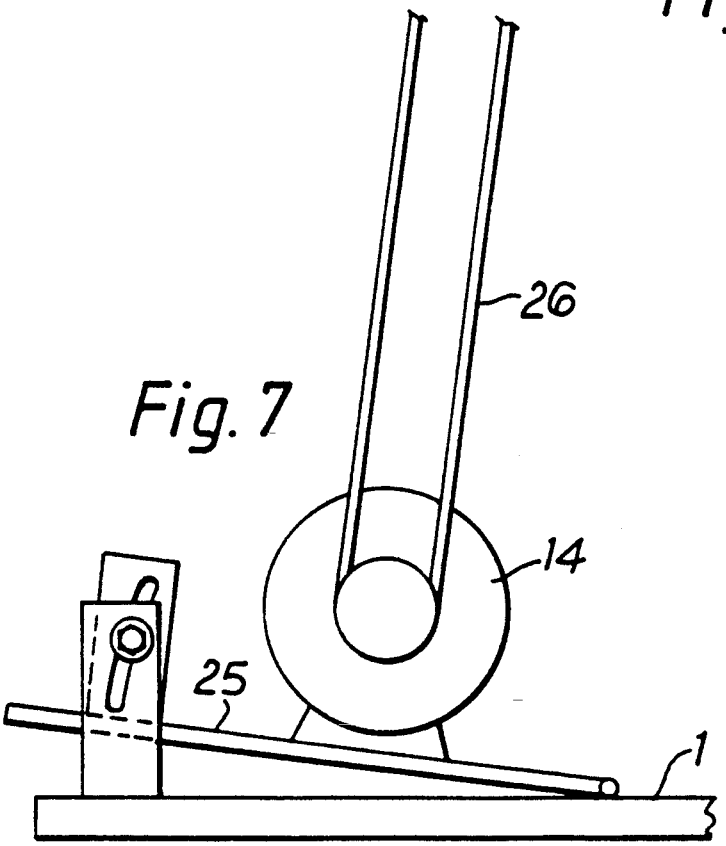
Figure 8:
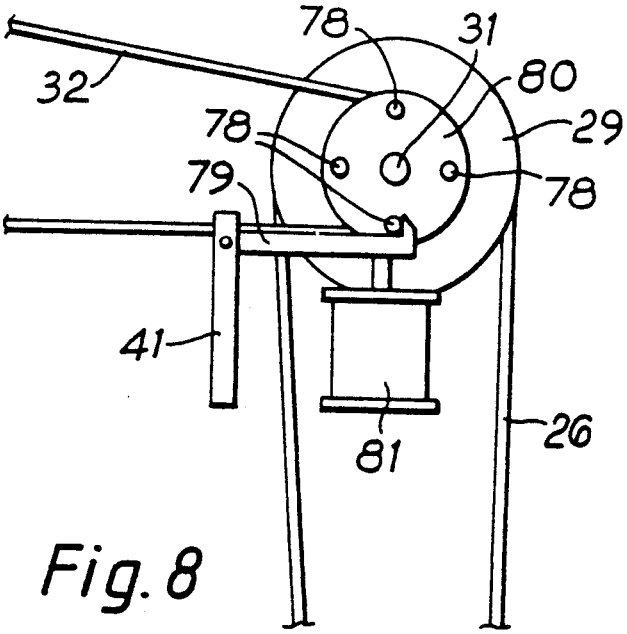
Figure 9:
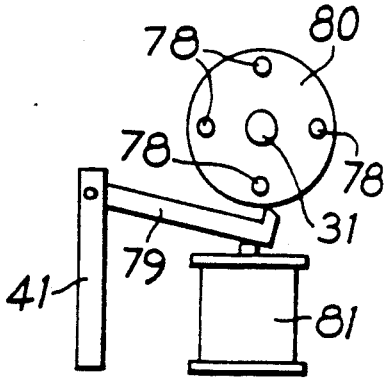
Figure 10:
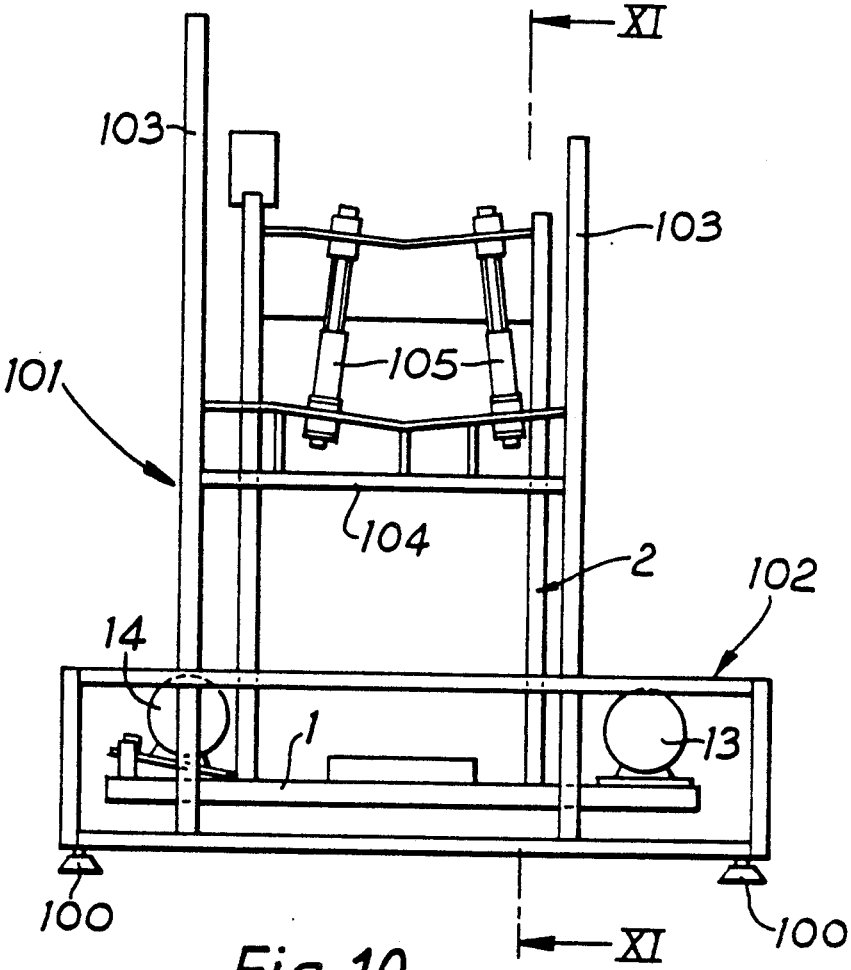
Figure 11:
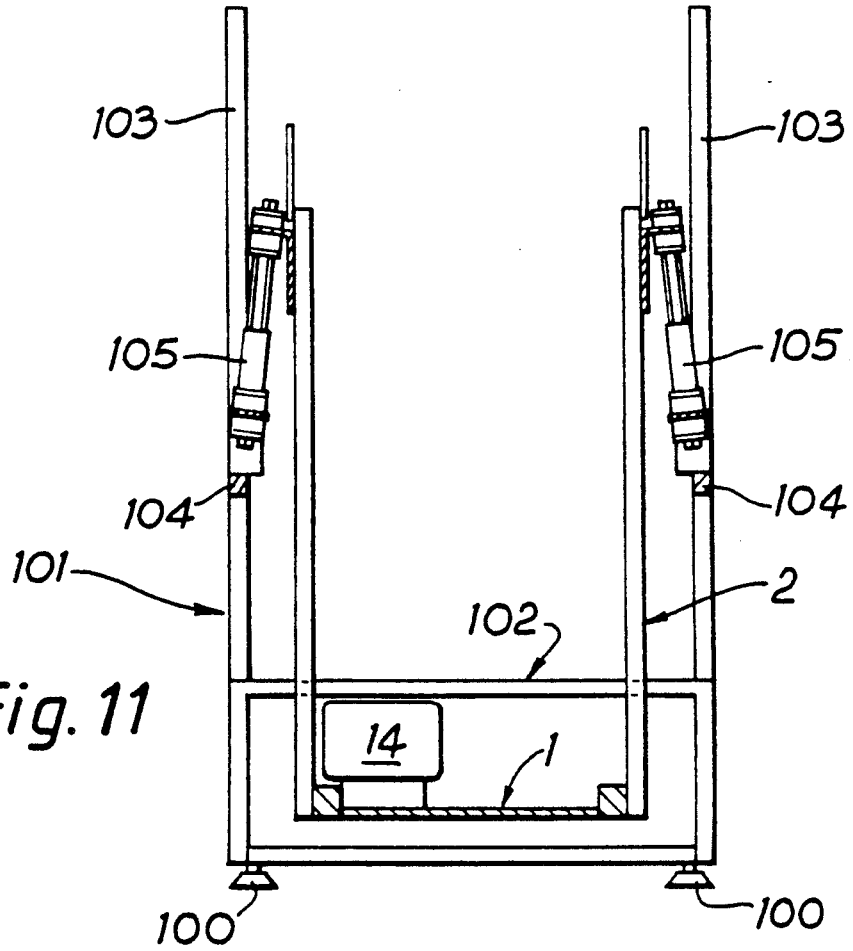
Figure 12:
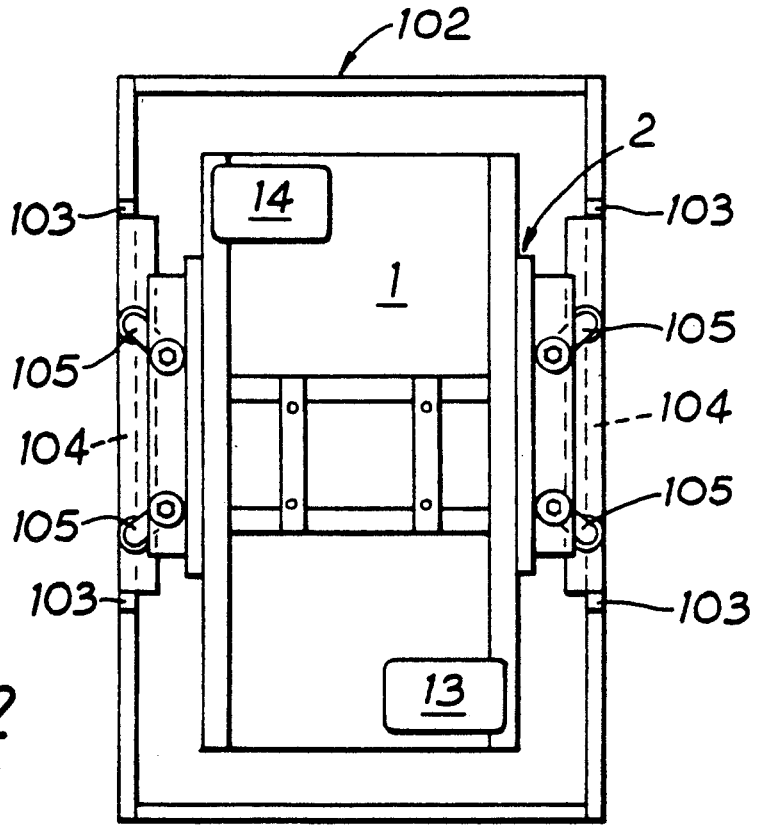
Figure 13:
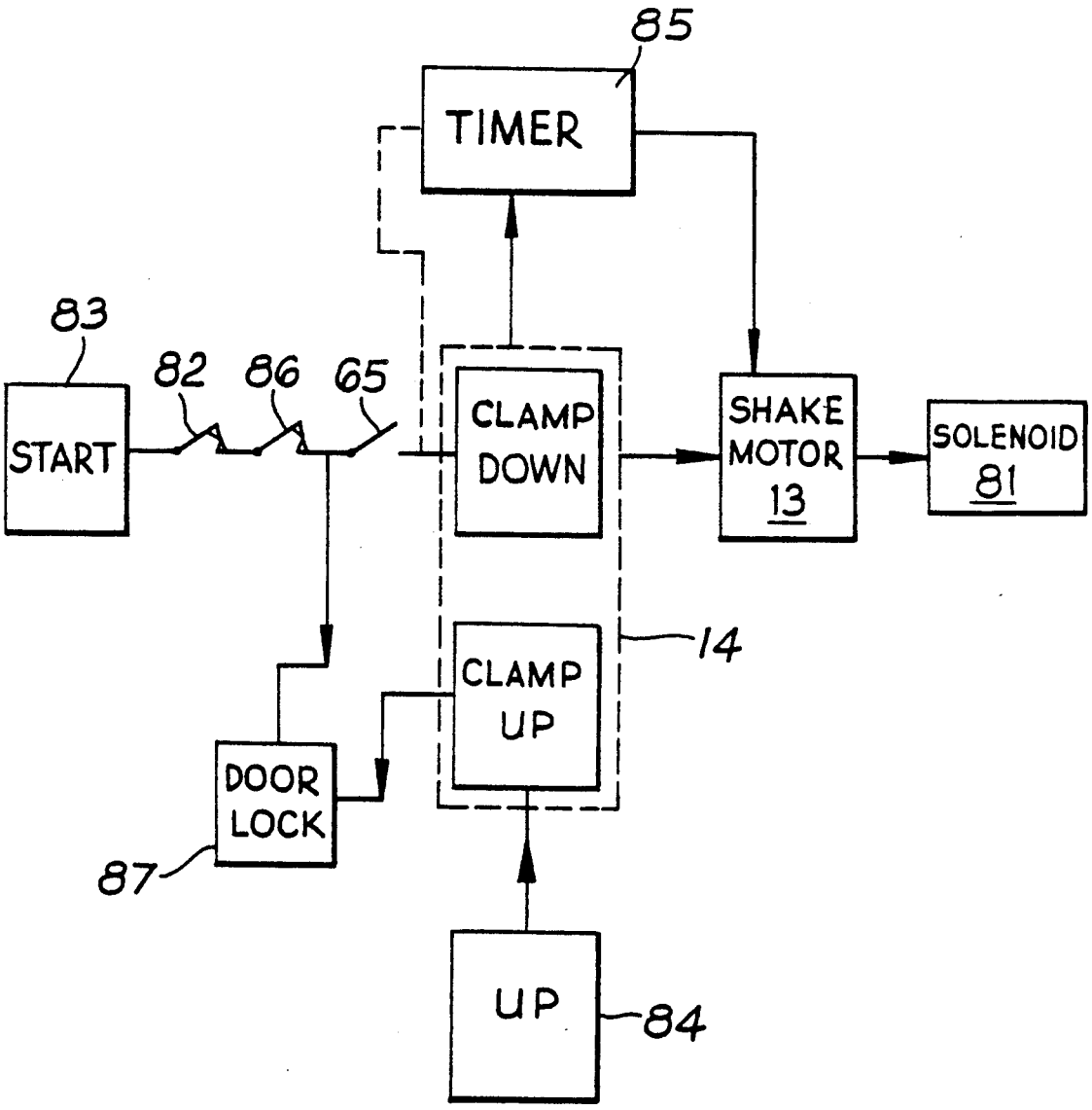

A vibratory mixer in accordance with the present invention will now be described in greater detail, by way of example, with reference to the accompanying drawings, in which:

FIG. 1 is a perspective view of the mixer,

FIG. 2 is a diagrammatic front view of the machine with certain components removed and others cut away, FIG. 3 is a plan view of FIG. 2, FIG. 4 is a side view of FIG. 2, FIG. 5 is a detail to a larger scale of FIG. 2, FIG. 6 is a section on the line VI—VI of FIG. 5, FIG. 7 is a detail to a larger scale of FIG. 4, FIG. 8 is a detail of FIG. 3, to a larger scale showing a component in an operative position, FIG. 9 is a part view of FIG. 8, to a smaller scale, showing the component in an inoperative position, FIG. 10 is a diagrammatic side view of the mixer of FIG. 1 with the casing removed, FIG. 11 is a section on the line XI—XI of FIG. 10, FIG. 12 is a plan view of FIG. 10 with certain parts removed, and FIG. 13 is a block circuit diagram of control means for the machine.

Referring first to FIGS. 1 to 7, the vibratory mixing machine is free standing on four feet secured beneath an outer main frame 101 which is covered by lower front, rear and side panels 10 and by upper side panels 3, a rear panel 4, a top panel 5, and partial front panels 6 between which is mounted a door 7 and above which is located a control panel 8 The outer main frame 101 comprises a base framework 102 to which the feet 100 are attached and an upright framework comprising four upright members 103 attached to the base framework 10 front and rear pairs of which are interconnected by support members 104 (FIGS. 10 to 12). A base 1 and an upright frame 2 are connected together to form a composite frame which is suspended from the outer main frame 101 by four resilient means such as shock absorbers 105 or springs (FIGS. 10 to 12). The base 1 extends beyond the upright frame 2 both to the front and to the rear to provide support for front and rear platforms 9 and 11, the former being a feed platform provided with staggered rows of rollers 12 to facilitate the loading of the machine as will be described.

The front of the base 1 accommodates an electric motor 13 operable to drive a vibratory mechanism, and hereinafter referred to as the shake motor, and the rear of the base 1 accommodates an identical electric motor 14 operable to effect clamping of a container and hence referred to hereinafter as the clamping motor The shake motor 13 has a pulley 15 connected to its output shaft 16, the pulley receiving a belt 17 which extends around a further pulley 18 attached to a shaft of an eccentric mechanism 19 employed to effect vibrational or shaking movement of an inner frame 21 which is connected to the upright frame 2 by resilient means (to be referred to hereinafter) having a damping effect The pulley 18 acts as a flywheel and is attached to the inner frame 21 by an eccentric pin 22 which is threadedly received by the pulley, is stepped axially to locate the pin and is formed with a square (or other shaped) head to enable it to be engaged by a spanner or the like for removal when the drive belt 17 has to be replaced which is necessary from time to time in view of the load thereon. Removal of the pin 22 opens up the gap between the pulley 18 and the inner frame 21 so as to allow fast belt replacement which is very cumbersome and time-consuming in known machines. The shake motor 13 is mounted on a plate 23 provided with slots through which pass bolts adjustably to secure the plate to the base 1, this arrangement allowing simple sliding movement of the plate, and hence motor, relative to the base 1 to effect tensioning of the belt 17. A further eccentric pin 24 attaches the other end of the vibratory mechanism 19 to the inner frame 21, this pin being carried by a counterpart 18' to the pulley 18, except that it is not grooved, to preserve balance, the counterpart also acting as a flywheel.

The clamping motor 14 is mounted on the base 1 via a plate 25 hinged to the base frame so as to effect simple tensioning of a drive belt 26 received by a pulley 27 on the output shaft 28 of the motor and extending upwardly to a pulley 29 connected to a countershaft 31 extending transversely of the machine. The belt 26 is a V-belt and a toothed drive belt 32 extends between a toothed pulley 33 on the countershaft 31 and a toothed pulley 34 on a further shaft 35 which also extends transversely of the machine.

The shaft 35 carries at one end a 45° bevel gear 36 which meshes with a similar bevel gear 37 carried at one end of a generally vertically-extending lead screw 38 which is rotatably mounted at the other end in a bracket 39 on the inner frame 21 such that lead screw is fixed in its axial direction. The inner frame 21 has a crosshead 41 (FIG. 3) extending between the opposed side members of the frame on which is mounted a pair of bearings (not shown) on either side of the pulley 34 for the shaft 35. The bevel gears 36,37 provide reduction gearing between the clamping motor 14 and the lead screw 38.

The lead screw 38 is located at one side of the inner frame 21 and a generally similar lead screw 42 is provided at the opposed side of the frame, the two lead screws being interconnected by a toothed drive belt 43 received by respective toothed pulleys 44 on the lead screws, whereby the latter are driven in unison. The lead screws 38 and 42 are received at their upper ends in, and guided by, bearings 45 attached to the crosshead 41 of the inner frame 21 with the lower ends rotatably mounted in respective brackets 39 (already referred to) and 46 attached to the inner frame 21. A clamping plate 47 extends between, and is carried by, the lead screws 38 and 42, being secured by respective pairs of nuts 48, the plate being faced or lined with a sheet of resilient material 49 (FIG. 2).

Between the lower ends of the side members of the inner frame 21 there extends a load platform 51 in the form of a plate which is also faced or lined opposite to the clamping plate lining 49 with a sheet of resilient material 42. Thus the inner frame 21, the lead screws 38 and 42, the clamping plate 47 and the load platform 51 all vibrate or shake when the shake motor 13 is energized.

Returning now to the lead screw 42, this is mounted so as to be axially movable (unlike the lead screw 38) in accordance with the principal feature of the present invention. This mounting is achieved by providing a pair of thrust races 53 and 54 (best seen in FIGS. 5 and 6) on the lead screw 42 on either side of the generally horizontal portion of the mounting bracket 46, the race 53 normally being held in contact with the bracket 46 by a stepped collar 55 engaging a shoulder 56 on the lead screw 42 on one side and the thrust race 53 on the other side. A spring 57 acts between a shoulder 58 on the collar 55 and the thrust race 53. The thrust race 54 is held in contact with the bracket 46 by a spring 59 (which is stronger than the spring 57) acting between the race and a washer 61 held against a further shoulder 62 on the lead screw 42 by a nut 63. The spring 59 surrounds a bush 64 which is shorter by 2 mm (or some other preselected measurement) than the axial distance between shoulder 62 and the underside of the thrust race 54.

Normally, the lead screw 42 is held in the position shown in FIGS. 2, 5 and 8 in which the upper end is spaced (preferably by 1 mm) from the actuating lever or button of a microswitch 65 mounted on the inner frame 21 and connected in circuit with the clamping motor 14. However, when subjected to an upward force (as will be described), the lead screw 42 moves upwardly until the washer 61 takes up the gap (2 mm) between itself and the lower end of the bush 64, whereupon further axial movement relative to the inner frame 21 is prevented by the bracket 46. This axial movement of the lead screw 42 increases (by 2 mm) the distance between the shoulder 56 on the lead screw and the bracket 46 but the spring 57 serves to hold the thrust race 53 in contact with the bracket, thus preventing the race from clattering. The fact that the spring 59 is stronger than the spring 57 means that the lead screw 42 is always held in the downward position of FIGS. 2, 5 and 6 unless subjected to an upward force.

It should be noted that the clamping plate 47 is purposely arranged to be out of parallel with the load platform 51 when the lead screw 42 is in the position of FIGS. 2, 5 and 6, the extent of non-parallelism being the amount of axial movement of the lead screw 42 which is permitted which is 2 mm in the illustrated embodiment. Thus the right-hand side (as seen from the front of the machine) of the clamping plate 47 is lower by 2 mm than the left-hand side so that when the lead screw 42 moves upwardly by 2 mm, the clamping plate 47 and the load platform will be parallel.

It is important that the countershaft 31 and the shaft 35 are maintained mutually parallel and to this end, they are interconnected by an adjustable linkage 66 (FIG. 4) comprising a link 67 having a cylindrical collar 68 at one end and containing a resilient bush 69 through which a bolt 71 extends to secure the link to the adjacent end of the countershaft 31. A similar link 72, collar 73, bush 74 and bolt 75 is associated with the adjacent end of the shaft 35. The two links 67 and 72 are slotted to receive respective bolts 76 extending through a connecting member 77, whereby the effective length of the overall linkage 66 can be adjusted to maintain the shafts 31 and 35 parallel when belt stretch occurs and when a new belt 32 is fitted. The linkage 66 is also used to connect the inner frame 21 to the upright frame 2, the bushes 69 and 74 serving as the resilient damping means previously referred to.

The end of the countershaft 31 opposite the pulley 29 is provided with disc 80 having a plurality of hardened pins 78 (FIGS. 8 and 9) extending from one side thereof and arranged on a circle. A pawl 79 is pivotally mounted at one end on the crosshead 41 of the inner frame 21 and is engageable at the other end with an adjacent pin 78 on the pulley when pivoted to the operative position (FIG. 8) by a solenoid 81 (FIG. 13). Thus the pawl, when in the operative position, prevents the countershaft 31 from rotating and thus locks the drive train 14, 26 to 38.

The control panel 8 is provided with an emergency switch 82, a START button or switch 83, an UP (unclamp) button or switch 84 and an adjustable timer 85, the components of the overall control circuit being housed in the top of the machine behind the control panel. FIG. 13 is a block diagram of the control circuit and shows the START switch 83 connected to the clamping motor 14 via the emergency switch 82 and the microswitch 65 associated with the lead screw 42, the microswitch normally being open when the lead screw is in the position of FIGS. 2, 5 and 6. Thus if the switches 82 and 65 are both closed and the START switch is operated, the clamping motor 14 will be energized, provided a door switch 86 has been closed by virtue of the door 7 has been properly closed. A door lock 87 is energized at the same time in order to prevent access to the interior of the mixer whilst the latter is operational. The clamping motor 14 will run until the microswitch 65 is opened by axial upward movement of the lead screw 42, the operation of the motor serving to drive the lead screw 38, via the drive train 26 to 37, and hence the lead screw 42 via the drive belt 43. The lead screws 38, 42 are driven in a direction such that the clamping plate 47 is driven (lowered) towards the load platform 51 on which has been placed one or more containers 88 holding the ingredients to be mixed, such as a base paint and tinter(s). If a container 88 is heavy, it can first be placed on the feed platform 9 and then pushed on to the load platform 51, this movement being facilitated by the feed platform rollers 12.

As soon as the clamping plate 47 contacts the top of the or each container 88, which must all be of the same height for a given operation of the mixer, the resulting reaction imparts an upward force on the lead screws 38 and 42 which has no effect on the lead screw 38 as it is axially fixed, but the lead screw 42 moves upwardly in the manner already described to actuate (close) the microswitch 65 and thus de-energize via relevant circuitry the clamping motor 14. The clamping motor 14 will run on a little after de-energization such that the clamping plate 47 will be driven further towards the load platform (these two components now being parallel) by up to 3 mm (depending on the extent of the inertia in the drive train 14, 26 to 38) which finalizes the clamping of the or each container 88 before vibration or shaking thereof is commenced.

Stringent tests have been carried out on the clamping arrangements for containers on the load platform 57 and have shown that it is extremely reliable, whereby under clamping or over clamping does not occur, thus overcoming the serious disadvantages of known mixers discussed above. Heavy metal containers of 30 kg in weight to small 1 liter plastic cans have been clamped and shaken by a given machine without problems When the clamping motor 14 has been de-energized, the timer 85 is rendered operative (which has been previously set to the desired duration for which shaking is required to effect thorough mixing of the ingredients in the container(s) 88, and the shake motor 13 energized for the set period of time. The shake motor 13 rotates the vibratory mechanism 19 and thus shakes or oscillates the inner frame 21 relative to the base frame 1 and upright frame 2. The load platform 51 is likewise shaken as is each container 88 thereon When the shake motor 13 is energized, the solenoid 81 associated with the pawl 79 is energized, thus pivoting the pawl into engagement with an adjacent pin 79 on the disc 80, whereby the drive train 14, 26 to 38 is locked so that no movement thereof due to the oscillation of the inner frame 21 can cause unclamping or further clamping movement of the clamping plate 47.

When the timer 85 times out, the shake motor 13 is de-energized as is the solenoid 81 so that the pawl 79 disengages the adjacent pin 78, thus freeing the drive train 14, 26 to 38. The circuit is so designed as to effect a short delay after shaking, after which an upward drive timing device then energizes the clamping motor 14 in the reverse direction, thus raising the clamping plate 47 to unclamp the container(s) 88, the extent of the raising of the clamping plate 47 being predetermined and when reached, de-energizes the clamping motor 14 and opens the door lock 87 to allow the door 7 to be opened and the container(s) 88 removed. If for some reason the clamping plate 47 has to be raised out of the normal sequence, the UP button 84 is actuated.

In order to prevent any likelihood of a container 88 being overclamped, thus probably damaging it and allowing the contents to leak, the clamping motor 14 is fused so that if the drive current exceeds a predetermined value, the motor will be de-energized.

It will be observed that the identical shake and clamping motors 13, 14 are located one at the front and one at the rear of the machine, on the base 1, and this is intentional so as to impart a basic balance in the fore-and-aft direction of the machine. The machine is symmetrical from side to side save for the components of the drive train 26 to 37 which give rise to a transverse imbalance. To compensate for this, the base frame 1 is weighted (for example by providing a solid frame component as opposed to a tubular component), whereby the machine is balanced both from front to rear and from side to side which makes it very stable. Furthermore, a counterbalance 106 (FIGS. 2 and 3) is provided on the shaft of the shaker 19 to compensate the weight of the moving inner frame 21.

The illustrated machine may be modified by providing a rear door as well as a front door and making the rear platform 11 an unloading platform, preferably fitted with rollers or other means to assist in the removal of containers thereto from the load platform 51. With this arrangement, a continuous (and automatic if required) loading, mixing, unloading sequence can be employed.

The present invention provides a vibratory mixer which effects very reliable clamping of containers to be vibrated and which are loaded and unloaded in a manner requiring the minimum of lifting. The clamping motor 14 is never electrically overloaded, in normal operation, and fluctuations in supply voltage has no significant effect on the final clamping force.

I claim:

1. A vibratory mixer for mixing ingredients by shaking comprising: a load platform (51) for receiving a container (88) which holds the ingredients to be mixed, clamping means (28, 42, 47) cooperable with the load platform to clamp a container therebetween, means (14, 26 to 48) for effecting relative movement between the load platform and the clamping means so as to clamp and unclamp a container, said means comprising at least one lead screw (38, 42) and a first motor (14) operable to drive said at least one lead screw, means for permitting axial movement of said at least one lead screw in response to clamping and unclamping of said clamping means (42), a second motor (13) operable to shake the load platform (51), control means operable to control a sequence of operation of the apparatus, said control means including switch means (65) connected in circuit with the first motor (14), said switch means being actuatable by said axial movement of said at least one lead screw (42) which takes place due to the reaction of a container (88) being clamped between the load platform (51) and the clamping means (47), whereby the first motor (14) is deenergized at a predetermined axial displacement of said at least one lead screw.

2. A mixer according to claim 1, wherein the switch means is disposed at one end of the at least one lead screw and spaced therefrom by a predetermined distance.

3. A mixer according to claim 1 or 2, wherein the at least one lead screw (42) is received in mounting means (46) attached to a frame (21) of the mixer and upper and lower thrust races (53, 54) are provided on said at least one lead screw on opposed sides of the mounting means, the upper thrust race (53) being held in engagement with the mounting means by upper spring means (57) acting between the upper thrust race and an upper abutment (55) fixed to the lead screw, and the lower thrust race (54) being held in engagement with the mounting means by lower spring means (59) acting between the lower thrust race and a de-energized, whereby a container (88) is automatically clamped, shaken and then unclamped.

4. A mixer according to claim 3, wherein the lower spring means (59) is stronger than the upper spring means, whereby the lead screw (42) is normally urged downwardly.

5. A mixer according to claim 4 wherein the clamping means (47) is normally out of parallel with the load platform (51) until movement of the axially movable lead screw (42) has taken place, whereupon the clamping means and load platform are substantially parallel when holding therebetween a container the contents of which are to be mixed.

6. A mixer according to claim 5, wherein the first motor (14) is arranged to overrun on being de-energized to effect final clamping movement of the clamping means (47).

7. A mixer according to claim 6, wherein the control means comprises timing means (85) operable to energize the second motor (13) once the first motor (14) has been de-energized.

8. A mixer according to claim 7, wherein the timing means (85) is also operable to re-energize the first motor (14) once the second motor (13) has been of the eccentric pin allowing ready replacement of the third endless drive means (17).

9. A mixer according to claim 8, wherein the first motor (14) drives said at least one lead screw (38, 42) via a drive train comprising first endless drive means (26) extending between the output shaft of the first motor and a countershaft (31), second endless drive means (32) extending between the countershaft (31) and a further shaft (35) substantially parallel to the countershaft (31) and carrying first bevel gear means (36) in mesh with second bevel gear means (37) carried by the driven lead screw (38), and wherein the countershaft and the further shaft are interconnected by an adjustable linkage (66), whereby the two shafts may be maintained substantially parallel.

10. A mixer according to claim 9, wherein locking means is provided for locking the drive train between the first motor and the clamping means when the first motor is de-energized, and the locking means comprises extensions (78) on a member associated with the drive train, and a pawl (79) actuatable by a solenoid (81) on de-energization of the first motor (14) so as to prevent further movement of the drive train.

11. A mixer according to claim 10, and further comprising a vibratory mechanism (19) driven by the second motor (13) via third endless drive means (17) and comprising flywheel means (18, 18') attached to an inner frame (21) of the mixer which inner frame carries the load platform (51) and which is suspended from an outer and stationary frame (101) for relative movement with respect thereto, the flywheel means being connected to the inner frame by a removable eccentric pin (22) threadedly received by the flywheel means, removal lower abutment (61) fixed to lead screw, with the lower spring means being disposed around bush means (62) slidably mounted on the lead screw and having an axial length less, by a predetermined amount, than the distance between the underside of the lower thrust race and the top of the lower abutment, whereby the lead screw may move upwardly by said predetermined amount until the distance between the underside of the lower thrust race and the top of the lower abutment is equal to the axial length of the bush means, whereupon further upward axial movement is prevented by the mounting means.

12. A mixer according to claim 11, wherein the first and second motors (14, 15) are adjustably mounted on a frame (2) of the mixer, whereby the tension in endless drive means (6, 17) associated therewith can be adjusted.

13. A mixer according to claim 12, wherein the first and second motors (14, 13) are identical and are disposed on opposed sides of a base (1) of the mixer to balance the mixer in one direction, and wherein counterweight means are provided to balance the drive trains associated with the first and second motors, whereby to balance the mixer is a second direction at right angles to the first direction.

14. A mixer according to claim 13, and further comprising a feed platform (9) provided with means (12) for assisting movement of a container (88) to and from the load platform (51).

15. A mixer according to claim 14, and further comprising an unloading platform (11) to receive a container from the load platform (51) once the contents thereof have been mixed.

16. A mixer according to claim 15, wherein the unloading platform (11) is provided with means for assisting movement of a container (88) from the load platform (51).

17. A mixer according to claim 16, wherein the means for assisting movement of the container comprises a series of freely rotatable rollers (12).

18. A mixer according to claim 16, wherein the means for assisting movement of a container comprises a series of driven rollers.

19. A mixer according to claim 8, wherein locking means (78, 79, 81) are provided for locking the drive train between the first motor (14) and the clamping means (47) when the first motor is de-energized.

20. A mixer according to claim 2, wherein the at least one lead screw is received in mounting means attached to a frame of the mixer, and upper and lower thrust races are provided on said lead screw on opposed sides of the mounting means, the upper thrust race being held in engagement with the mounting means by upper spring means acting between the upper thrust race and an upper abutment fixed to the lead screw, and the lower thrust race being held in engagement with the mounting means by lower spring means acting between the lower thrust race and a lower abutment fixed to the lead screw, with the lower spring means being disposed around bush means slidably mounted on the lead screw and having an axial length less, by a predetermined amount, than the distance between the underside of the lower thrust face and the top of the lower abutment, whereby the lead screw may move upwardly by said predetermined amount until the distance between the underside of the lower thrust race and the top of the lower abutment is equal to the axial length of the bush means, whereupon further upward axial movement is prevented by the mounting means, and wherein said predetermined amount is greater than said predetermined distance.

21. A mixer according to claim 20, wherein said lower spring means is stronger than said upper spring means, whereby said lead screw is normally urged downwardly.

22. A mixer according to claim 1, wherein said clamping means is normally out of parallel with said load platform until movement of said at least one lead screw of which axial movement is permitted has taken place, whereupon said clamping means and load platform are substantially parallel when holding therebetween a container the contents of which are to be mixed.

23. A mixer according to claim 1, wherein said first motor is arranged to overrun on being de-energized to effect final clamping movement of said clamping means.

24. A mixer according to claim 1, wherein said control means comprises timing means operable to energize said second motor once said first motor has been de-energized.

25. A mixer according to claim 24, wherein said timing means is also operable to re-energize said first motor once said second motor has been de-energized, whereby a container is automatically clamped, shaken and then unclamped.

26. A mixer according to claim 1, wherein said first motor drives said at least one lead screw via a drive train comprising first endless drive means extending between said output shaft of said first motor and a countershaft and a further shaft substantially parallel to said countershaft and carrying first bevel gear means in mesh with second bevel gear means carried by said driven lead screw, and wherein said countershaft and said further shaft are interconnected by an adjustable linkage, whereby the two shafts may be maintained substantially parallel.

27. A mixer according to claim 1, further comprising a drive train between said first motor and said clamping means and locking means for locking said drive train when said first motor is de-energized.

28. A mixer according to claim 1, further comprising a frame and endless drive means associated with said first and second motors wherein said first and second motors are adjustably mounted on said frame, whereby the tension in said endless drive means can be adjusted.

29. A mixer according to claim 1, wherein drive trains are associated with said first and second motors, and said first and second motors are identical and are disposed on opposite sides of a base of said mixer to balance said mixer in one direction, and wherein counterweight means are provided to balance the drive trains associated with said first and second motors, thereby to balance said mixer in a second direction at right angles to the first direction.

30. A mixer according to claim 1, and further comprising a feed platform provided with means for assisting movement of a container to and from said load platform.

31. A mixer according to claim 30, and further comprising an unloading platform to receive said container from said load platform once the contents thereof have been mixed.

32. A mixer according to claim 1, further comprising third endless drive means, an outer, stationary frame, an inner frame carrying said load platform, said inner frame being suspended from said outer, stationary frame for relative movement with respect thereto, and a vibratory mechanism driven by said second motor via said third endless drive means, said vibratory mechanism comprising flywheel means connected to said inner frame by a removable eccentric pin threadedly received by said flywheel means, whereby removal of said eccentric pin allows ready replacement of said third endless drive means.

33. A vibratory mixer for mixing ingredients by shaking comprising a base, a load platform (51) supported for movement relative to said base for receiving a container (88) which holds the ingredients to be mixed, clamping means (47) cooperable with the load platform to clamp a container therebetween, means (14, 26 to 48) for effecting relative movement between the load platform and the clamping means so as to clamp and unclamp a container, first motor means (14) forming part of said means to effect said relative movement, and second motor means (13) operable to effect shaking of the load platform to mix the ingredients in a clamped container, characterized in that the first and second motor means (14, 13) are mounted on said base in the same horizontal plane as one another and on opposite sides of said load platform so as substantially to balance the machine in one direction.

* * * * *